US005808537A

United States Patent [19]

Kondo et al.

[11] Patent Number: 5,808,537

[45] Date of Patent: Sep. 15, 1998

[54] INDUCTOR CORE FOR TRANSFERRING ELECTRIC POWER TO A CONVEYOR CARRIAGE

[75] Inventors: Tadashi Kondo; Masaki Takasan; Yasuharu Odachi, all of Kariya, Japan

[73] Assignee: Kabushiki Kaisha Toyoda Jidoshokki Seisakusho, Kariya, Japan

[21] Appl. No.: 931,068

[22] Filed: Sep. 15, 1997

[30] Foreign Application Priority Data

Sep. 16, 1996 [JP] Japan ..... 8-266813
Sep. 16, 1996 [JP] Japan ..... 8-266814

[51] Int. Cl.[6] ..... H01F 27/24; H01F 21/04; H01F 21/06

[52] U.S. Cl. ..... 336/233; 336/234; 336/129; 336/212; 336/130

[58] Field of Search ..... 336/212, 233, 336/234, 83, 129, 130; 307/104; 361/144, 145, 146

[56] References Cited

U.S. PATENT DOCUMENTS 2,664,541 12/1953 Henderson ..... 336/234

FOREIGN PATENT DOCUMENTS 5-207606 8/1993 Japan .
40 6030503A 2/1994 Japan .
172 01 01 A1 3/1992 U.S.S.R. ..... 336/212

*Primary Examiner*—Michael L. Gellner
*Assistant Examiner*—Anh Mai
*Attorney, Agent, or Firm*—Brooks Haidt Haffner & Delahunty

[57] ABSTRACT

A pickup device has a core to which a coil is wound about. The core has a body formed by laminating a plurality of plates having a predetermined shape. Eddy currents produced by leakage flux is suppressed at the ends of the core. This is achieved by laminating a plate, which has a certain shape and is made of a material having a higher electric resistance value than the body, to the ends of the body. The generation of eddy currents may also be suppressed by providing notches at the ends of the core to obstruct the formation of a magnetic circuit at the ends. As another option, space may be provided at the ends of the core to disconnect the path of eddy currents.

26 Claims, 13 Drawing Sheets

INDUCTOR CORE FOR TRANSFERRING ELECTRIC POWER TO A CONVEYOR CARRIAGE

BACKGROUND OF THE INVENTION

1. Field of the Invention

The present invention relates to cores for transferring electric power to rail-mounted conveying carriages.

2. Description of the Related Art

In the prior art, carriages that travel along a suspended rail to transfer articles between stations are known. Japanese Unexamined Patent Publication No. 5-207606 describes such an apparatus. In the apparatus, a pickup unit provided on the carriage is opposed to a power cable, which extends along a rail, in a non-contacting state. Electromotive induction occurs in the pickup unit when alternating current (high frequency current) flows through the cable. This transfers electric power to the pickup unit.

As shown in FIG. 19, in this apparatus, a pickup unit 81 includes an E-shaped core 83 and a coil 84. Two power cables 82 extend parallel to each other along a rail. The core 83 is arranged to almost surround the two cables 82. The coil 84 is wound about an arm 83*a* that projects from the middle of the core 83. High frequency alternating current flowing through the cable 82 forms a magnetic circuit in the core 83. The magnetic flux of the magnetic circuit is oriented in the direction indicated by the arrows in FIG. 19. The induction of electric current in the coil 84 is based on the magnetic circuit.

In the prior art, the core 83 is made of ferrite. However, ferrite is difficult to machine and easily cracks and chips. Chipping of the core 83 forms areas that are not included in the magnetic circuit and decreases the power generating efficiency of the core 83. To solve such problems, the core 83 may be produced by laminating a plurality of E-shaped plates that are made of a ferromagnetic material such as steel (e.g., silicon steel), as shown in FIG. 20.

The current induced by the coil 84 and the high frequency current flowing through the cable 82 forms a main magnetic flux and a reversed magnetic flux in the core 83. Interference between the magnetic fluxes disturbs the main magnetic flux and produces leakage flux $\phi$, especially about the coil at each end of the core 83, as shown in FIG. 21. If the core 81 is made of silicon steel or other steel materials, the leakage flux $\phi$ generates eddy currents I at each end surface of the core 83, and especially at the end surfaces of the arm 83*a*, one of which lies in the plane of FIG. 22. This produces undesirable heat at the sides of the arms 83*a* that are located at the ends of the core 83.

Heating of the end surfaces of the core 83*a* may damage the coil 84. To prevent such damage, the coil 84 must be coated by a material having a high heat resistance. This increases the production cost of the pickup unit 81. Therefore, the core 83 is not made of silicon steel or other steel materials in the prior art.

SUMMARY OF THE INVENTION

Accordingly, it is an objective of the present invention to provide cores for supplying electric power to conveying apparatuses that decrease the heat generated by eddy currents and that have improved durability.

It is a further objective of the present invention to lower the production costs of such cores.

To achieve the above objectives, the present invention provides a core mounted provided in a pickup device that is attached to a movable body capable of travelling along a guide. The core has a coil wound therearound to obtain electric power based on an electromagnetic induction from alternating current flowing through an electric cable extending along the guide. The core includes a core body and a control means for controlling eddy current caused by leakage flux. The control means is located at an end of the core body to form an end surface of the core.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 5(*b*) and 5(*c*) are perspective views, each showing an E-shaped core according to a further embodiment of the present invention;

FIG. 5(*d*) is a perspective view showing an E-shaped core provided with a bobbin according to a further embodiment of the present invention;

FIG. 5(*e*) is a side view of the bobbin;

FIG. 5(*f*) is a cross-sectional view of the bobbin;

FIGS. 9(*b*), 9(*c*), 9(*d*), and 9(*e*) are partial perspective views showing the C-shaped core of FIG. 9(*a*);

FIG. 11(*b*) is a perspective view showing a C-shaped core segment formed by laminating the C-shaped plates;

FIG. 18(*b*) is a diagrammatic front view of a C-shaped core according to an further embodiment of the present invention;

DETAILED DESCRIPTION OF THE PREFERRED EMBODIMENTS

A first embodiment according to the present invention will now be described with reference to FIGS. 1 to 4.

Figure 4:
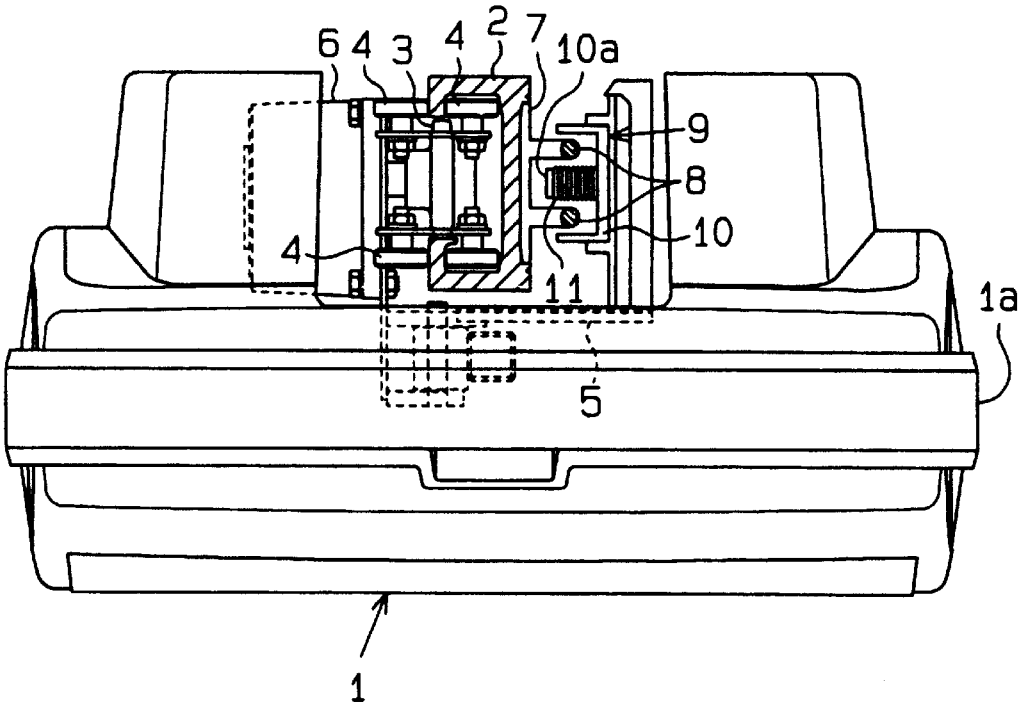
FIG. 4 is a front view showing a carriage.
Figure 5A:
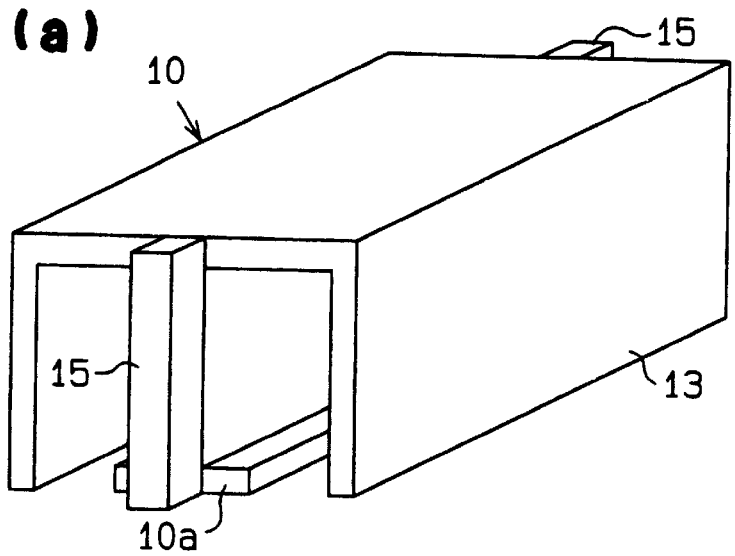
FIG. 5(*a*) is a perspective view showing an E-shaped core according to a second embodiment of the present invention.
Figure 5B:
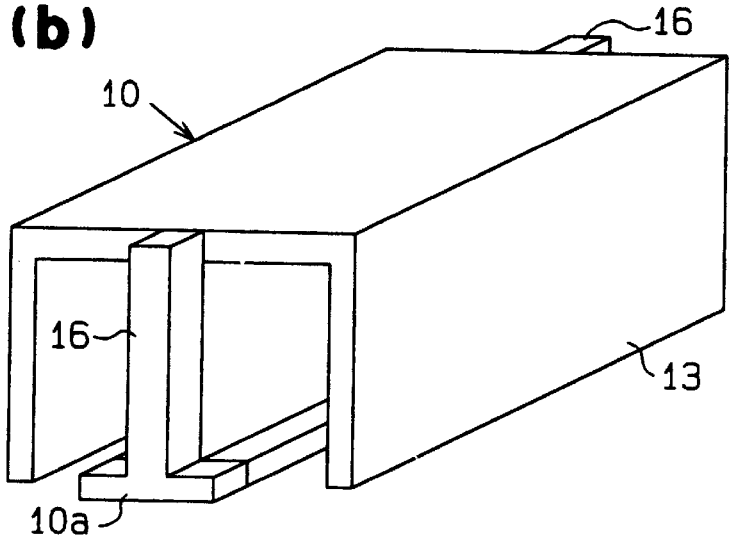
Figure 5C:
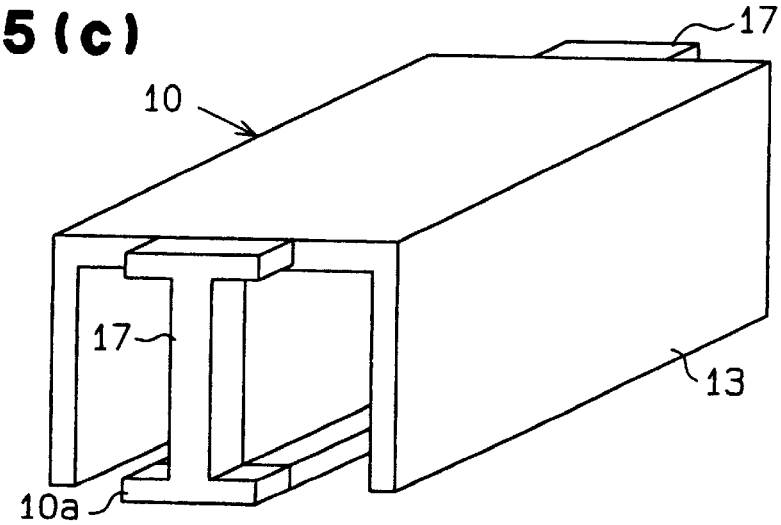
Figure 5D:
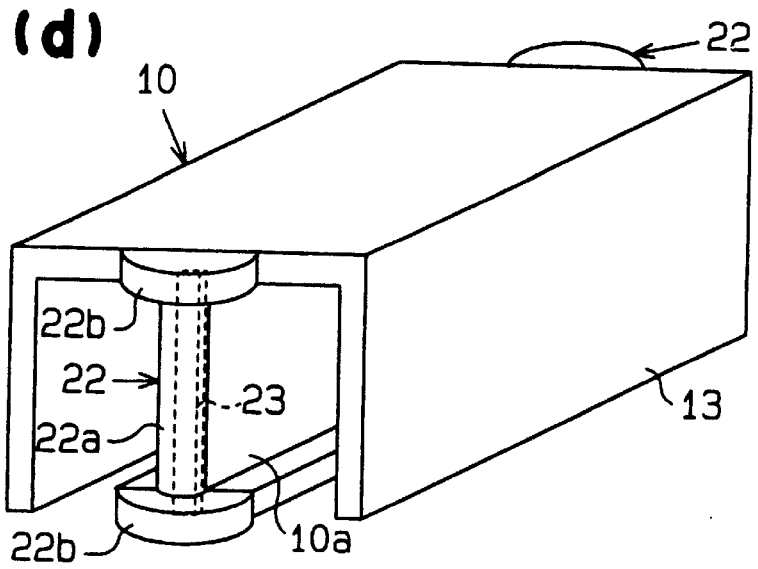
Figure 5E:
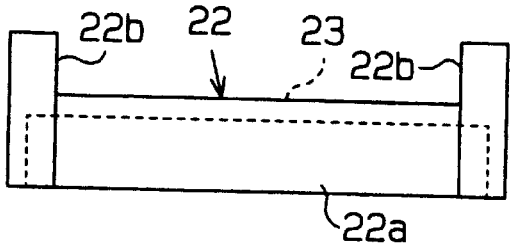
Figure 5F:
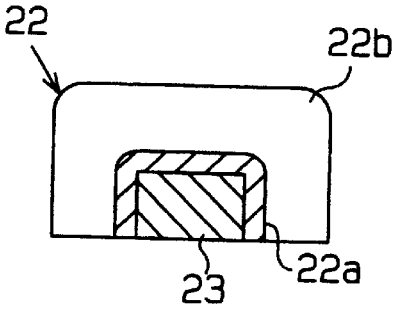

As shown in FIG. 4, a carriage 1 is supported by a rail 2 suspended from a ceiling. The carriage 1 travels along the rail 2.

The carriage 1 has a front drive wheel 3, a rear driven wheel (not shown), and guide wheels 4. The carriage 1 also has a body 1*a* that is held on front and rear steering units 5. The steering units 5 support the steering wheels 3, 4 and are pivotal about vertical axes to allow the wheels 3, 4 to be steered in accordance with the radius of curvature of the rail 2. A motor 6 is also provided on one of the steering units 5 to drive the drive wheel 3.

Supporters 7 are fixed to the rear side of the rail 2 (to the right as viewed in FIG. 4) at predetermined intervals to hold a power cable 8. Two cables 8 are connected to each other at an end of the rail 2. The cables 8 are parallel to each other and are spaced a predetermined distance from each other. High frequency current flows through the cable 8.

A pickup device 9 is arranged on each steering unit 5, and each is opposed to the cables 8 in a non-contacting manner. The pickup device 9 includes an E-shaped core 10, an arm 10*a* projecting from the middle of the core 10, and a coil 11 wound about the arm 10*a*. The coil 11 is arranged substantially halfway between the two cables 8. The front and rear pickup devices 9 are electrically connected to each other in series.

The structure of the core 10 will now be described with reference to FIGS. 1 and 2.

Figure 1:
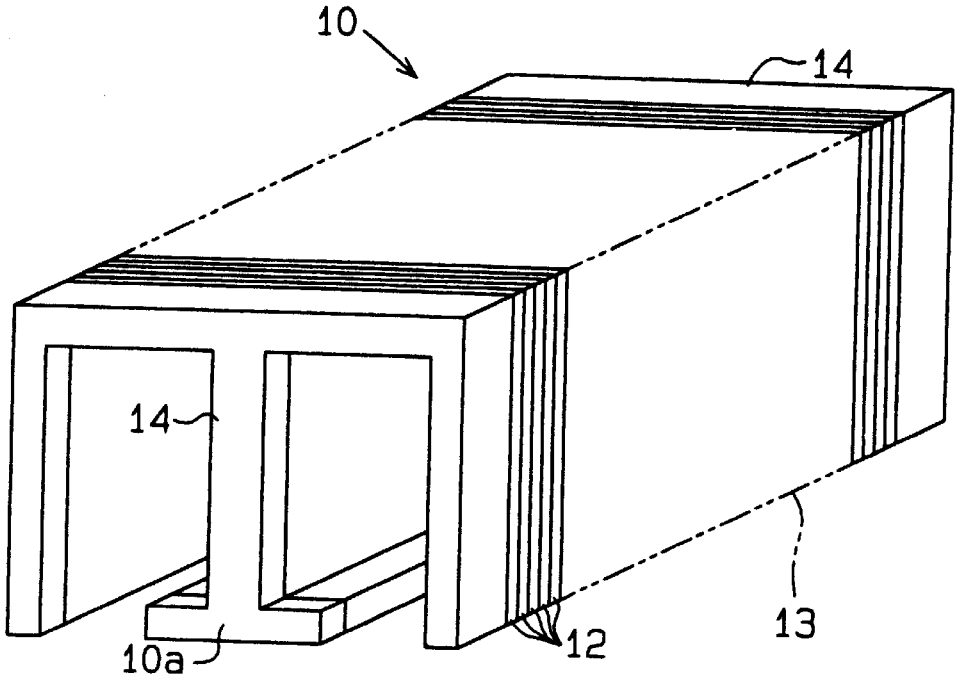
FIG. 1 is a perspective view showing an E-shaped core according to a first embodiment of the present invention.

As shown in FIG. 1, the core 10 includes a core body 13, which is formed having a predetermined length by laminating a plurality of plates 12 with an adhesive. Each plate 12 is E-shaped and made of silicon steel. A ferrite attachment 14 is secured to each end of the body 13. The plates 12 are formed by punching E-shaped pieces out of a silicon steel sheet.

Figure 2:
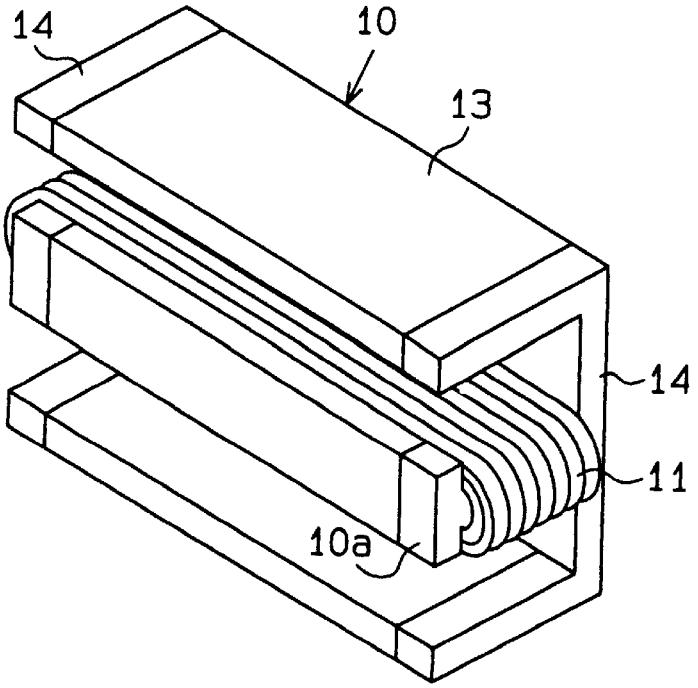
FIG. 2 is a perspective view showing a pickup device that employs the E-shaped core.

As shown in FIG. 2, a pickup device 9 is constituted by winding a coil 11 about the arm 10*a* of the core 10. An electric wire normally used for ferrite cores (wire that is not coated with a heat resistant material) is employed in the coil 11.

Figure 3:
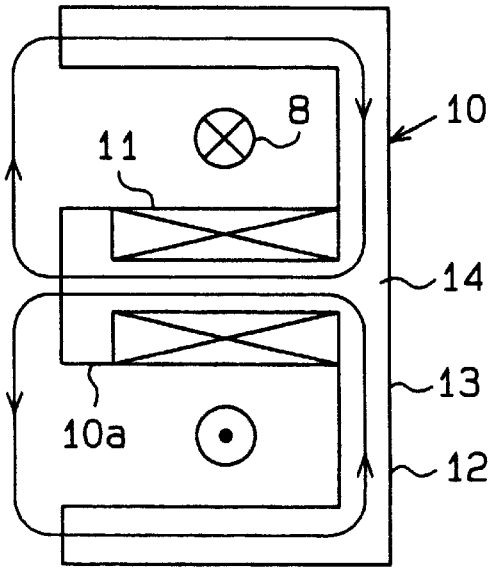
FIG. 3 is a diagrammatic front view showing the magnetic circuits formed in the E-shaped core.

As shown in FIG. 3, the high frequency current flowing through the cable 8 forms a magnetic circuit having a main magnetic flux oriented in the direction indicated by the arrow. The coil 11 induces electric current having the same frequency as the high frequency electric current. The electric current induced by the coil 11 forms magnetic flux that is oriented in the opposite direction of the main magnetic flux. This offsets and disturbs the main magnetic flux. The disturbance causes leakage flux $\phi$, which is oriented in a direction parallel to the cables 8 (a direction perpendicular to the plane of FIG. 3), at the ends of the E-shaped core 10.

However, each end of the core 10 is provided with the ferrite attachment 14, which has an insulating property. Furthermore, each ferrite attachment 14 has a predetermined thickness that enables the ferrite attachment 14 to extend for a sufficient distance to obstruct the eddy currents generated by the leakage flux $\phi$. This prevents the leakage flux $\phi$ from producing eddy currents at the end surfaces of the core 10. As a result, heating of the end surfaces of the arm 10*a* is suppressed. Thus, although the coil 11 employs an electric wire usually used for ferrite cores instead of a wire coated with heat resistant material, heat does not damage the arm 10*a*. Accordingly, the core 10 can be made of an inexpensive material. Furthermore, inexpensive wire may be used as the coil 11. This reduces the costs of manufacturing the pickup device 9.

The ferrite attachments 14 provided on the ends of the core 10 are E-shaped in the same manner as the core body 13. This enables the alternating current flowing through the cable 8 to form the magnetic circuit about the ferrite attachments 14. Thus, the ferrite attachments 14 that are provided to suppress the generation of eddy currents contribute to the induction of electric current by the coil 11.

The ferrite attachments 14 are provided only at the ends of the core 10. Thus, chipping or cracking of the ferrite material is significantly decreased in comparison with the ferrite cores employed in the prior art. This avoids decreases in the power generating efficiency of the core 10 caused by cracking or chipping of the ferrite material in comparison to the prior art ferrite cores. Thus, the same power generating efficiency of the core 10 is maintained over a long period of time.

The body 13 that constitutes each core 10 is formed by laminating a plurality of identical plates 12. Thus, when the employment of a different type of carriage 1 necessitates changes in the size (length) of the core 10, the core 10 may be modified simply by changing the number of plates 12 constituting the body 13. This enables the ferrite attachments 4 to be used commonly among different cores 10 and further reduces the cost of manufacturing the cores 10.

In addition, the ferrite attachments 14 are E-shaped in the same manner as the body 13 to form a magnetic circuit about the ferrite attachments 14. This contributes to the induction of electric current by the coil 11 and enhances the power generating efficiency (electric power converting efficiency) per unit length of the core 10. The enhanced efficiency relatively shortens the length of the core 10 that is required for the necessary electric power. Thus, a more compact pickup device 9 is produced.

Due to heating problems, silicon steel was not used as the material of the core 10 in the prior art despite its magnetic property being superior to ferrite. However, the present invention employs silicon steel and allows the core 10 to have a magnetic property that is superior to that of ferrite cores. The employment of silicon steel improves the electric power converting efficiency of the pickup device 9.

A second embodiment according to the present invention will now be described with reference to FIG. 5(*a*). In this embodiment, the ferrite attachment has a shape that is simple and suppresses heat generation, which damages the coil 11.

As shown in FIG. 5(*a*), the body 13 of the core 10 is formed by laminating a plurality of plates 12 in the same manner as the first embodiment. A ferrite bar attachment 15 is secured to the ends of the arm 10*a*. Thus, the ferrite bar attachments 15 sandwich the arm 10*a* and suppresses eddy currents in the arm 10*a*. This suppresses heating of the arm 10*a*.

It is required that ferrite material be provided at the ends of the arm 10*a*. Therefore, the ferrite bar attachment 15 may be replaced by a T-shaped ferrite attachment 16, as shown in FIG. 5(*b*), or an H-shaped ferrite attachment 17, as shown in FIG. 5(*c*). Thus, the ferrite attachments 15–17 are obtained by removing portions of the E-shaped ferrite attachment 14 of the first embodiment. Although a magnetic circuit is formed in the ferrite, no eddy currents are generated at these removed portions.

Since the ferrite attachments 15, 16, 17 have a simple shape and are relatively small, cracking of chipping is further suppressed in comparison to the E-shaped ferrite attachments 14 of the first embodiment.

The size of the ferrite attachments 15–17 are not restricted as long as they sandwich the arm 10*a* from both ends. The small size of the ferrite attachments 15–17 saves costs when producing the ferrite attachments 15–17. Furthermore, heating of the arm 10*a* is substantially suppressed by the ferrite attachments 15–17. This allows electric wire that is normally used for ferrite cores to be employed in the coil 11.

The ferrite attachments may also be formed as shown in FIGS. 5(*d*), 5(*e*), and 5(*f*). As shown in FIG. 5(*d*), a resin bobbin 22 is attached to each end of the arm 10*a* by an adhesive or the like. The bobbins 22 prevent the formation of the magnetic circuit at the ends of the arm 10*a*. As shown in FIGS. 5(*e*) and 5(*f*), each resin bobbin 22 has a semicylindrical shaft 22*a*, the diameter of which is equal to the width of the arm 10*a*, and a pair of outer pieces 22*b* arranged at each end of the shaft 22*a*. A bar-shaped ferrite attachment 23 is embedded in the bobbin 22 at the side that contacts the arm 10*a*.

The ferrite attachment 23 embedded in each resin bobbin 22 suppresses the generation of eddy currents when leakage flux $\phi$ occurs near the ends of the core 10. Thus, heating of the arm 10*a* at locations near its ends is suppressed. The coil 11 wound about the arm 10*a* is also wound about the shaft 22 of each bobbin 22. Therefore, contact between the coil 11 and the outer pieces 22*b* restricts movement of the coil 11 in a direction perpendicular to the winding direction of the coil 11. That is, the outer pieces 22*b* of the bobbin 22 prevent displacement of the coil 11.

Instead of embedding the ferrite attachment 23 in each resin bobbin 22 as shown in FIGS. 5(*d*) to 5(*f*), the entire bobbin may be made of a ferrite material.

A further embodiment according to the present invention will now be described with reference to FIG. 6. In this embodiment, the ferrite attachment 14 of the first embodiment is replaced by a metal attachment.

Figure 6:
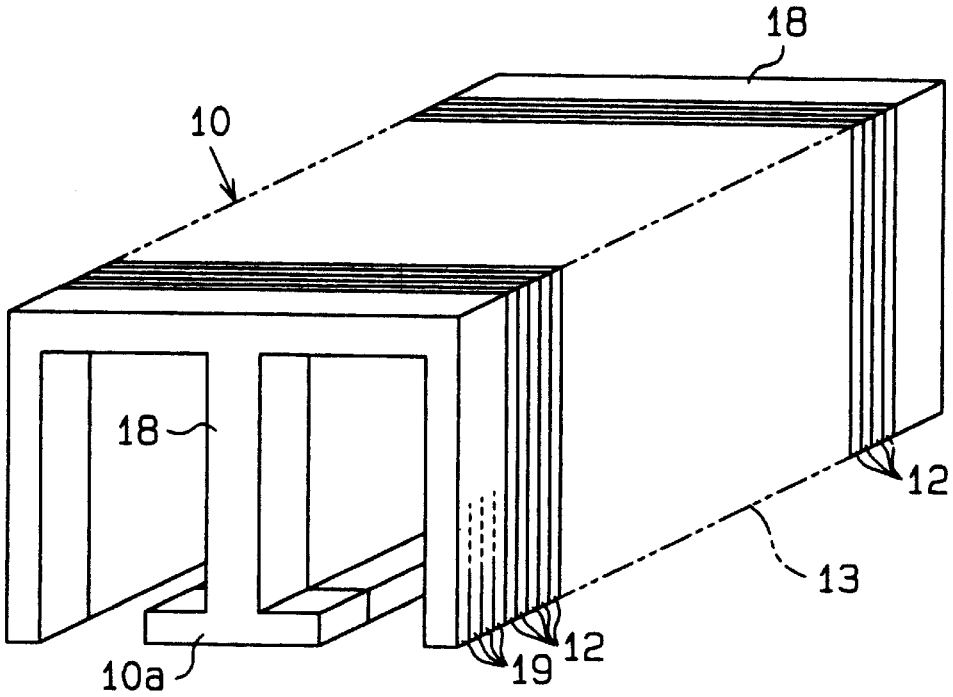
FIG. 6 is a perspective view showing an E-shaped core according to a further embodiment of the present invention.

As shown in FIG. 6, an amorphous attachment 18 made of an amorphous magnetic material (metal material) is secured to the ends of the body 13 of the core 10 to suppress the generation of eddy currents. Each amorphous attachment 18 is formed by laminating amorphous plates 19, which are E-shaped and identical to the plates 12 constituting the body 13. The amorphous magnetic material employed in this embodiment is a steel having an electrical resistance value that is much higher than silicon steel (e.g., four times or higher), which is the material of the core 13.

Thus, the relatively large electric resistance value of the amorphous attachment 18 minimizes the eddy currents that may be generated by leakage flux $\phi$ at the ends of the core 10.

Since the amorphous attachment 18 is made of metal, the entire core 10 is constituted by a metal material. Thus, the core 10 does not crack or chip. This structure avoids deterioration of the power generating efficiency of the core 10 and thus ensures a constant power generating efficiency over a long period of time.

A magnetic circuit is formed at the location of each amorphous attachment 18 by the alternating current flowing through the cable 8. Thus, the amorphous attachment 18 contributes to the induction of secondary current by the coil 11 and improves the power generating efficiency of the pickup device 9.

The amorphous attachment 18 is formed by laminating the amorphous plates 19, which are E-shaped and identical to the plates 12 constituting the core body 13. Therefore, the punch die used to produce the plates 12 may also be used to produce the plates 19. This decreases the production costs of the amorphous plates 19. Furthermore, the lengths of the cores 10 may be altered simply by changing the number of the plates 12 or the amorphous plates 19. To counter eddy currents, the thickness of the amorphous attachment 18 may be changed appropriately by simply changing the number of amorphous plates 19.

A further embodiment according to the present invention will now be described with reference to FIG. 7. This embodiment does not suppress the generation of eddy currents but suppresses leakage flux, which causes eddy currents.

Figure 7:
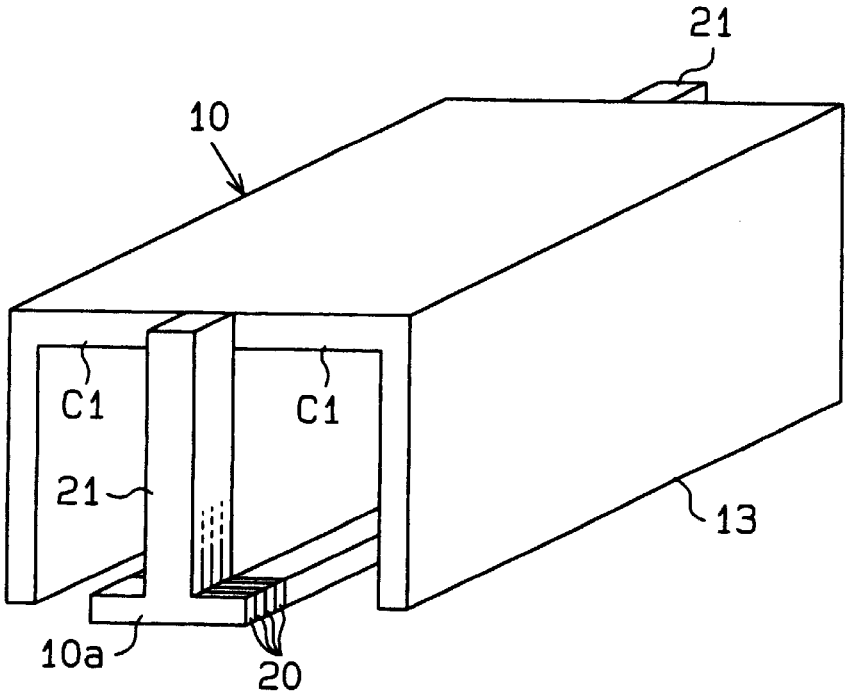
FIG. 7 is a perspective view showing an E-shaped core according to a further embodiment of the present invention.
Figure 9A:
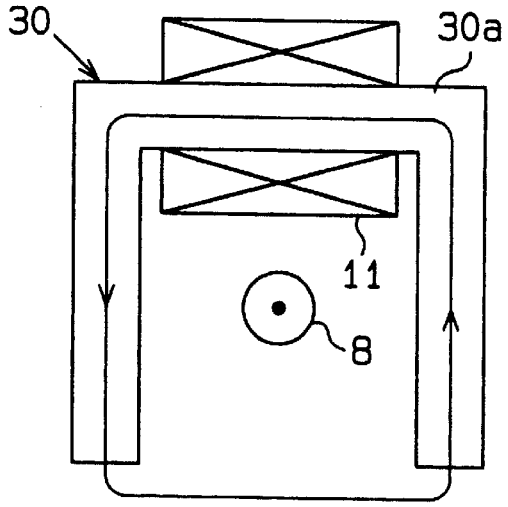
FIG. 9(*a*) is a diagrammatic front view showing the magnetic circuit of a C-shaped core according to a further embodiment of the present invention.
Figure 9B:
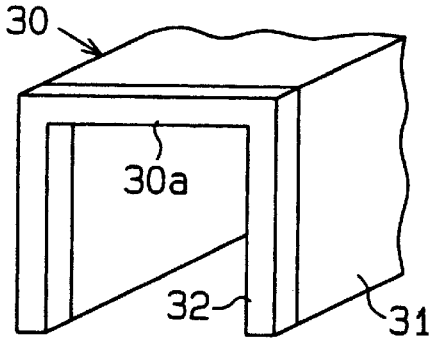
Figure 9C:
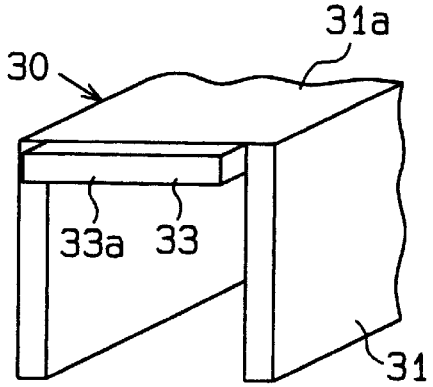
Figure 9D:
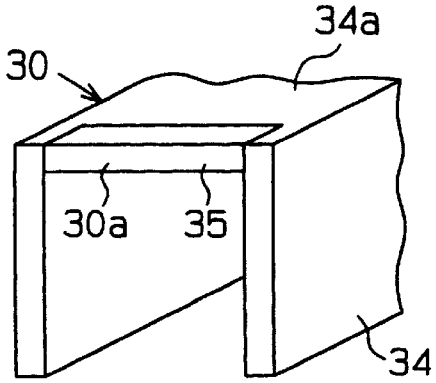
Figure 9E:
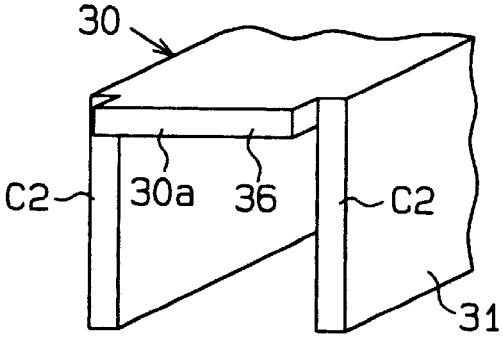
Figure 10:
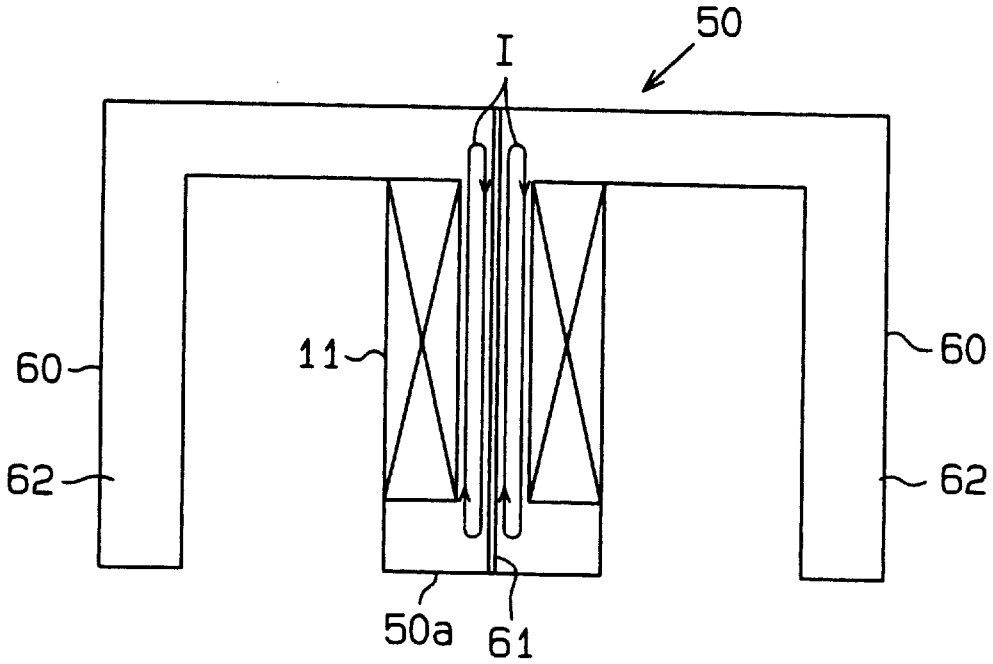
FIG. 10 is a diagrammatic front view of an E-shaped core according to a further embodiment of the present invention.

As shown in FIG. 7, a steel attachment 21, formed by laminating T-shaped plates 20 made of silicon steel, is secured to the ends of the body 13. A space C1 is defined at each side of the steel attachment 10*a*. The plates 20 are formed by punching T-shaped pieces out of a silicon steel sheet.

The magnetic circuit (or main magnetic flux) generated by the alternating current flowing through the cable 8 is not formed at the portions where the space C1 is located. This eliminates disturbance of the main magnetic flux caused by the coil 11 and minimizes the leakage flux $\phi$, which, in turn, reduces the generation of eddy currents and suppresses heating of the arm 10*a*. Thus, normal wire may be used in the coil 11 without having to worry about heat.

The core 10 is made of a metal material. This prevents cracking and chipping of the core 10. Furthermore, the plates 12 of the core body 13 and the plates 20 of the steel attachment 18 are easily formed by punching from steel sheets. This saves manufacturing costs of the core 10. Furthermore, the plates 12, 20 may be employed in cores 10 having different lengths.

Figure 8:
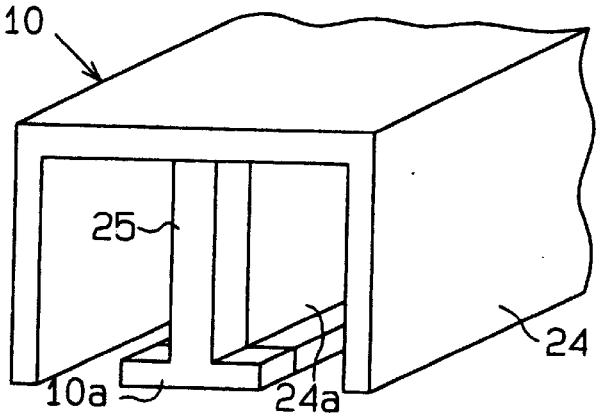
FIG. 8 is a partial perspective view showing an E-shaped core according to a further embodiment of the present invention.

A further embodiment according to the present invention will now be described with reference to FIG. 8. In this embodiment, the ends of the arm 24*a* are not flush with the ends of the core 10 and are located at positions inward from the ends of the core 10. A T-shaped ferrite attachment 25 is secured to each end of the arm 24*a* so that the main magnetic flux also extends through the ferrite attachment 25.

The magnetic circuit formed by the ferrite attachment 25 contributes to the induction of secondary current by the coil 11. This improves the power generating efficiency of the pickup device 9. The improved efficiency allows the length of the core 10 to be shortened. This results in a more compact pickup device 9.

FIGS. 9(*a*) to 9(*e*) show further embodiments according to the present invention. As shown in FIG. 9(*a*), a core 30 is C-shaped so as to surround a single cable 8. The coil 11 is wound about a winding portion 30*a*. The alternating current flowing though the cable 8 forms a magnetic circuit as shown by the arrows.

FIG. 9(*b*) shows a C-shaped ferrite attachment 32 secured to each end of a core body 31 (formed by laminating C-shaped plates), thus forming a C-shaped core 30. This structure suppresses the generation of eddy currents and heat. In addition, a magnetic circuit is also formed at positions corresponding to the ferrite attachments 32. This improves the power generating efficiency of the core 30.

The ferrite attachment 32 may be replaced by an attachment made of an amorphous material. This allows the entire core 30 to be made of a metal material and prevents cracking or chipping of the core 30.

FIG. 9(*c*) shows bar-shaped ferrite attachment 33 secured to each end of the body 13 at a position corresponding to the winding portion 31*a*. In this structure, in comparison with the ferrite attachment of FIG. 9(*b*), the shape of the ferrite attachment 33 is simpler and smaller. This further decreases the likelihood of cracking and chipping of the ferrite attachments 32.

FIG. 9(*d*) shows a recess defined at each end of the winding portion 34*a*. A ferrite attachment 35 is fit into the recess so that the main magnetic flux extends through the ferrite attachment 35. This structure enables the advantageous effects of the core 30 shown in FIG. 9(*c*) to be obtained. In addition, the ferrite attachment 35 contributes to the improvement of the power generating efficiency. Thus, the power generating efficiency of the C-shaped core 30 per unit length is enhanced.

FIG. 9(*e*) shows a projection 36 that projects from each end of the winding portion 31*a*. The projections are made of the same material as the body 31. A space C2 is defined at each end of the projection 36 so that a magnetic circuit is not formed at positions corresponding to each end of the winding portion 30*a*. This structure suppresses the generation of leakage flux and minimizes the heating of the winding portion 30*a*.

The ferrite attachments employed in the above embodiments may be replaced by attachments made of a magnetic material having insulating properties.

A further embodiment according to the present invention will now be described with reference to FIGS. 10 to 13.

Figure 12:
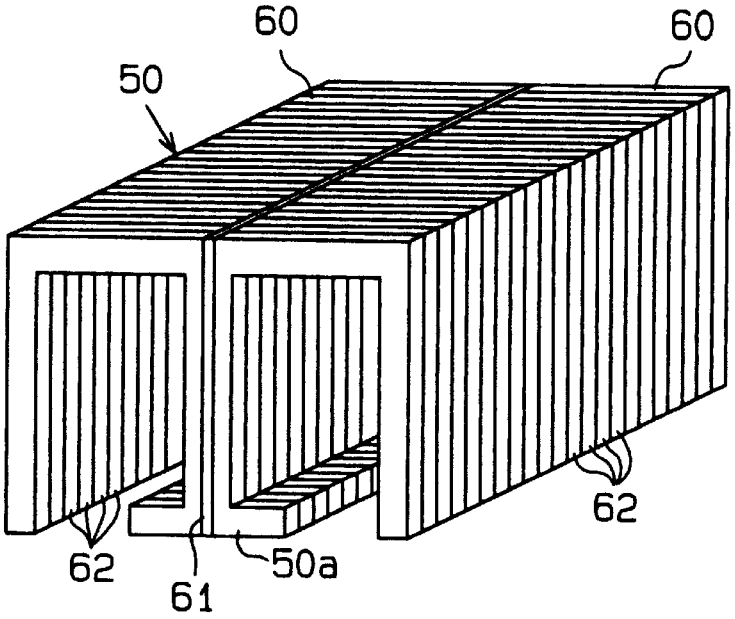
FIG. 12 is a perspective view of the E-shaped core of FIG. 10.

As shown in FIG. 12, an E-shaped core 50 is constituted by securing two C-shaped core segments 60 to each other with an adhesive. The adhesive has insulating properties. Thus, the two C-shaped cores segments 60 are secured to each other with a predetermined space in between by an adhesive in a non-conductive manner. As a result, an arm 50*a* formed at the middle of the core 50 is partitioned into two parts by an insulating layer 61 defined by the adhesive.

Figure 11:
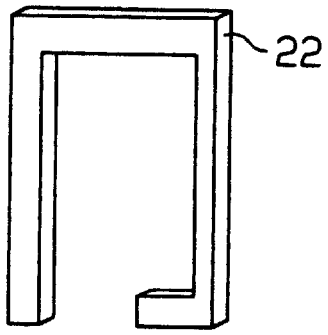
FIG. 11(*a*) is a perspective view showing a C-shaped plate that forms a segment of the E-shaped core of FIG. 11(*b*)
Figure 11:
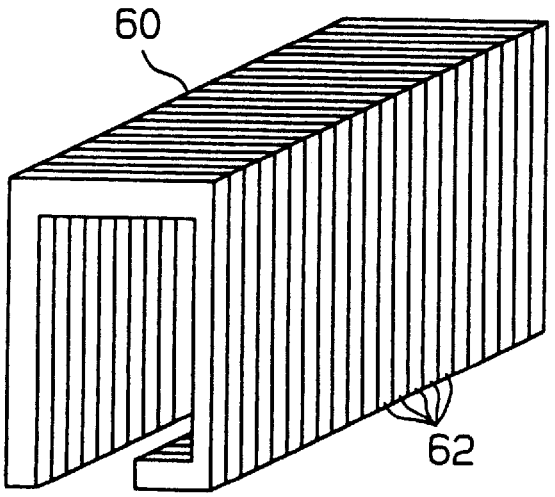

As shown in FIG. 11(*a*), each core segment 60 is formed having a predetermined length by laminating a plurality of C-shaped plates 62 with an adhesive. Each plate 62 is formed by punching out a silicon steel sheet.

Figure 13:
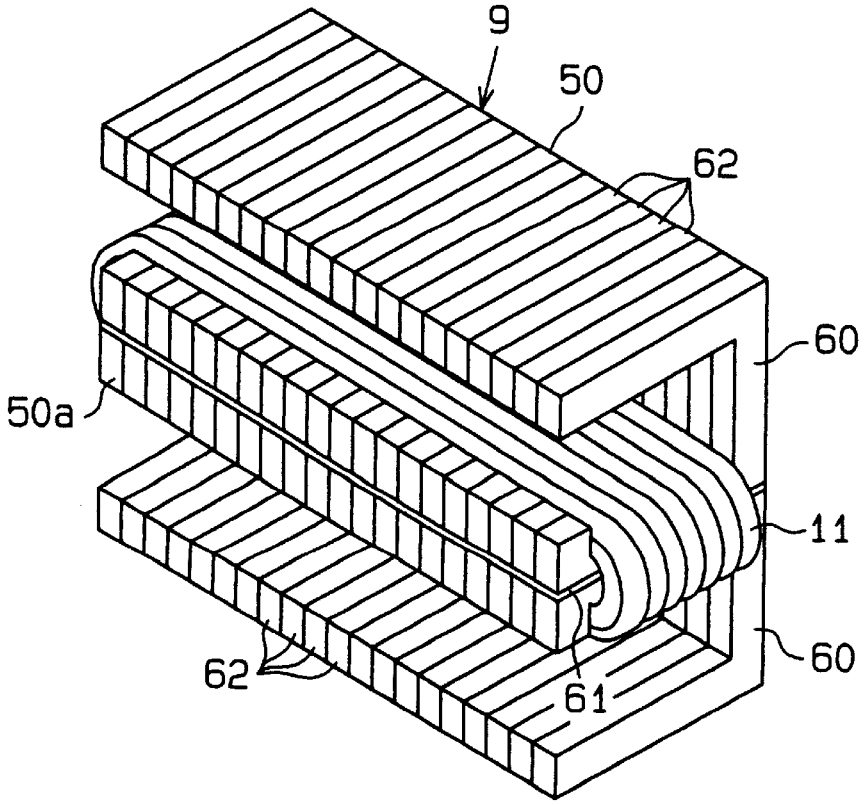
FIG. 13 is a perspective view showing a pickup device employing the E-shaped core of FIG. 10.

As shown in FIG. 13, the coil 11 is wound about the arm 50*a* to constitute the pickup device 9. When the thickness of the insulating layer 61 is insufficient, a resin sheet may be arranged between the segments 60 to increase the thickness of the layer 61. The coil 11 employs wire normally used for ferrite cores and does not employ wire coated with heat resistant materials.

In the pickup device 9, the insulating layer 61 disconnects the path of the eddy currents and decreases the eddy currents generated at the arm 50*a*. That is, at each end of the arm 50, the eddy currents flow within two small regions partitioned by the insulating layer 61. This decreases the magnitude of the eddy currents and suppresses heating of the end surfaces of the arm 50*a*. Thus, wire used normally for ferrite cores may be employed in the coil 11, since there is no need to worry about damage caused by heat generated by magnetic leakage flux.

In this embodiment, a gap may be provided between the core segments 50 in lieu of the insulating layer 61. In this case, the two core segments 50 are arranged on a supporting base with a gap provided in between. The gap is wide enough to disconnect the path of the eddy currents. The coil 11 is wound about the arm 50*a*. In this state, the pickup device 9 is coupled to the carriage 1 together with the supporting base.

More than one insulating layer or gap may be provided between the two core segments 60.

In this embodiment, the core 50 is made of silicon steel plates. This prevents cracking and chipping that would occur if ferrite cores were used. Thus, the same power generating efficiency is maintained over a long time period.

Further embodiments according to the present invention will now be described with reference to FIGS. 14 and 15.

Figure 14:
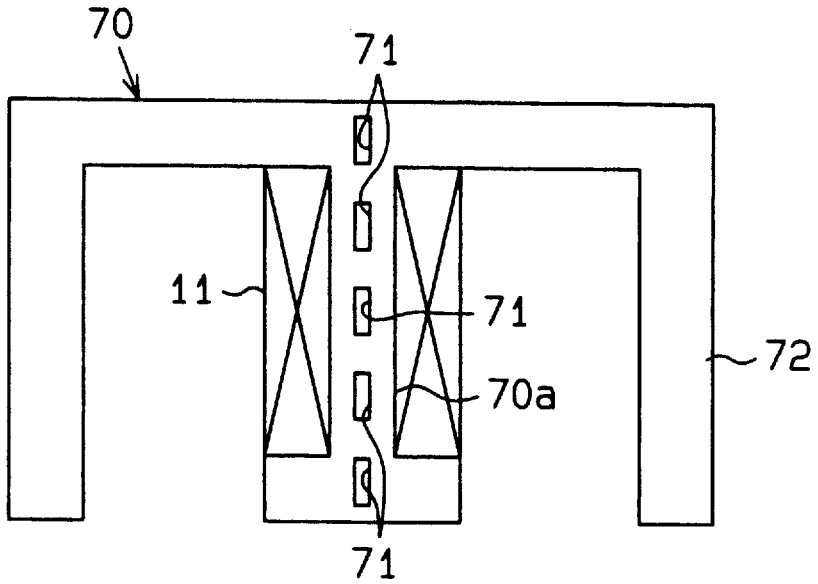
FIG. 14 is a front view of an E-shaped core according to a further embodiment of the present invention.

FIG. 14 shows an E-shaped core 70 provided with an arm 70*a*. A row of spaced openings 71 extend along the middle of the arm 70*a* so as to divide the arm 70*a* into two parts. The openings 71 intermittently disconnect the path of the eddy currents generated at the arm 70*a* by leakage flux $\phi$. This suppresses the generation of eddy currents and heat at the ends of the arm 70*a*.

The core 70 has a predetermined length and is formed by laminating a plurality of E-shaped plates 72. The plates 72 are punched out from silicon steel sheets. The openings 71 extend through the arm 70*a* of each plate 72. The plates 72 are connected to one another so that the corresponding openings 71 are aligned and extend through the core 70. Thus, the openings 71 divide the end surfaces of the arm 70*a*, which is where eddy currents tend to be produced, into two parts.

Figure 15:
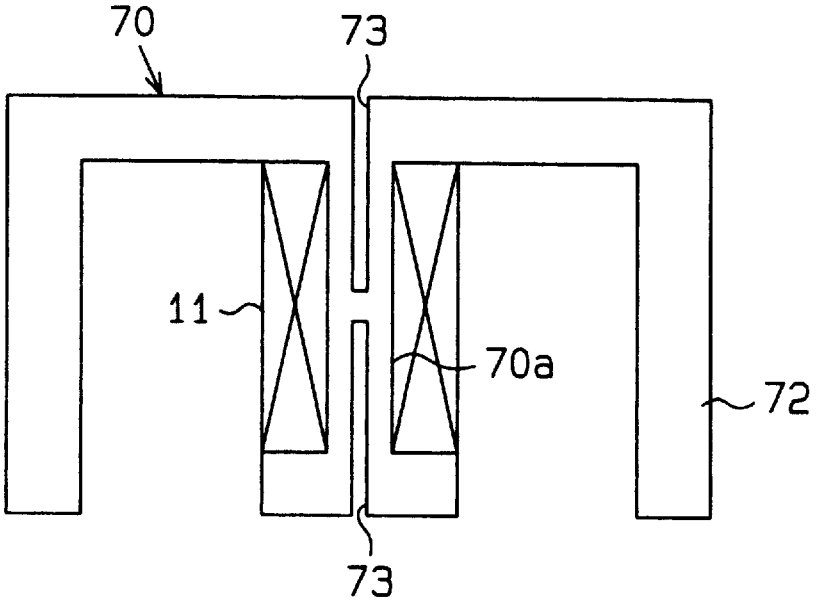
FIG. 15 is a front view showing an E-shaped core according to a further embodiment of the present invention.

The core 70 shown in FIG. 15 has a pair of aligned slits 73 in each plate 72. The plates 72 are aligned and connected to one another to form the core 70. Thus, the arm 70*a* is divided into two portions by the slits 73. This disconnects the path of the eddy currents produced in the arm 70*a* by leakage flux $\phi$.

The core 70 is manufactured simply by laminating the plates 72, which have the openings 71 or the slits 73. In addition, when punching out the plates 72, the openings 71 or the slits 73 may simultaneously be punched out. Thus, the path of eddy currents may be disconnected without additional machining steps.

A further embodiment according to the present invention will now be described.

Figure 16:
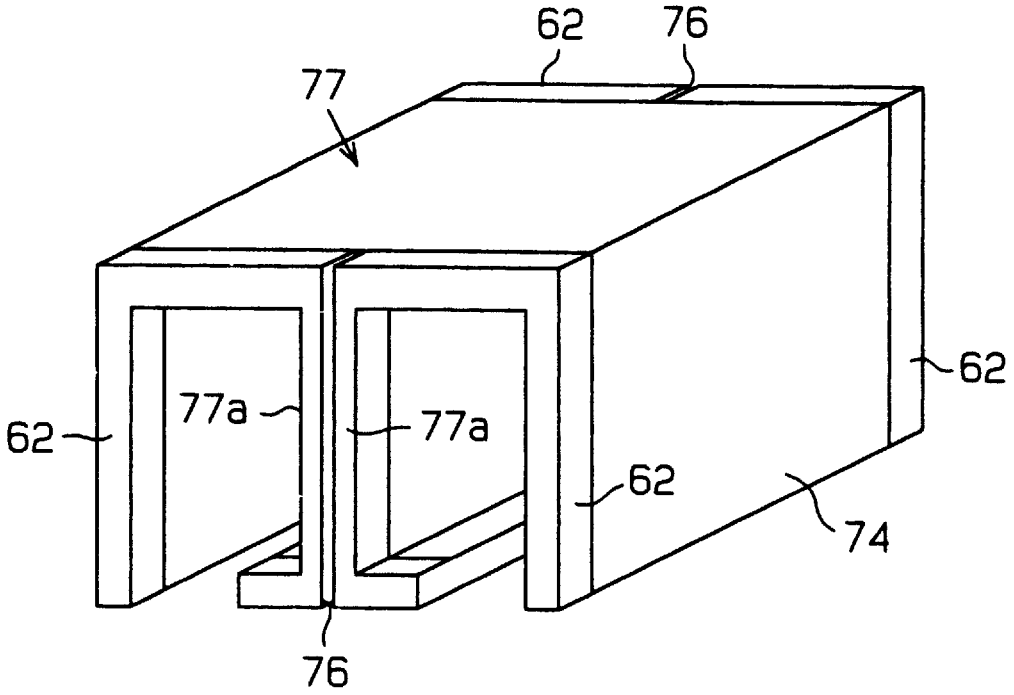
FIG. 16 is a perspective view showing an E-shaped core according to a further embodiment of the present invention.

FIG. 16 shows a core 77 provided with a body 74 and an arm 77*a*. The body 74 is formed by laminating a plurality of E-shaped plates. A pair of C-shaped attachments 62 are secured to each end of the body 74. A gap 76 is provided between the plates 62.

The gap 76 divides the end surfaces of the arm 77*a* into two parts. This suppresses the generation of eddy currents and heat at the ends of the arm 35*a*.

Figure 17:
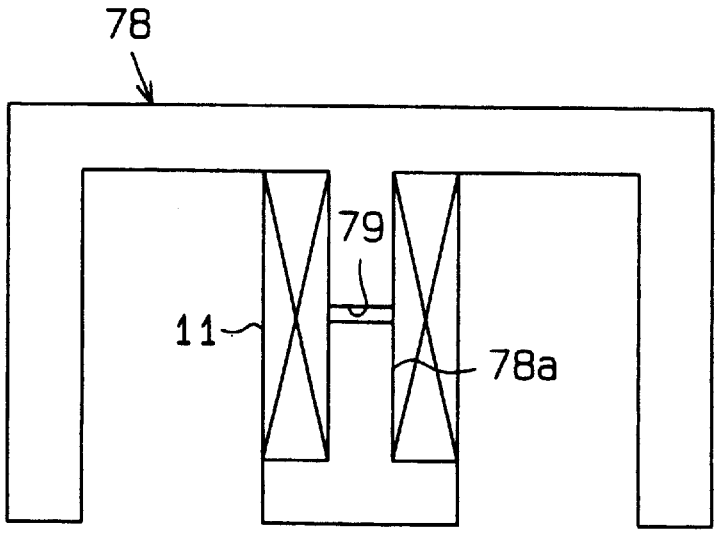
FIG. 17 is a perspective view showing an E-shaped core according to a further embodiment of the present invention.

A further embodiment according to the present invention will now be described with reference to FIG. 17. A core 78 is provided with an arm 78*a*. The arm 78*a* has a slit 79 that divides the arm 78*a* into two parts. The slit 79 disconnects the path of the eddy currents and suppresses heat generated at the end surfaces of the arm 78*a*.

Figure 18A:
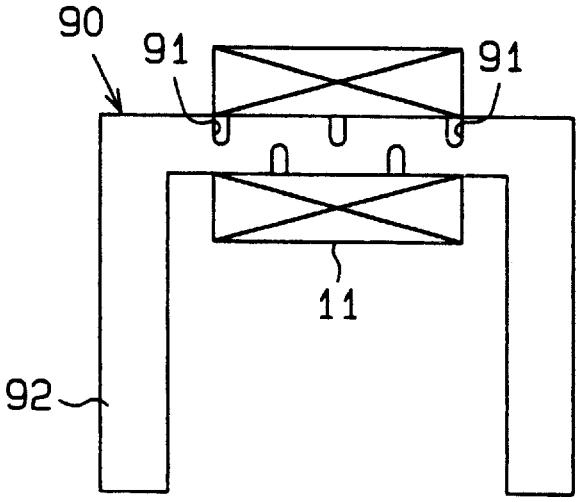
FIG. 18(*a*) is a diagrammatic front view of a C-shaped core according to an further embodiment of the present invention.
Figure 18B:
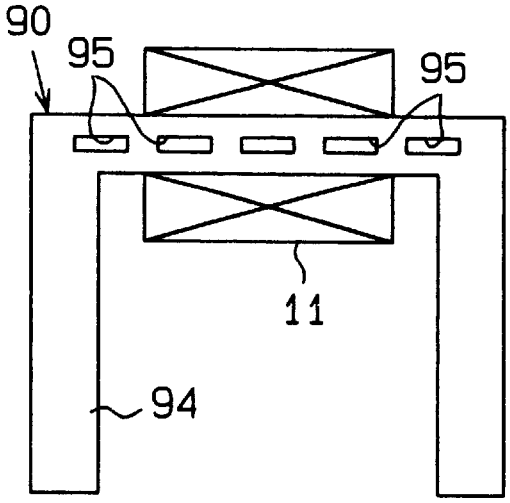
Figure 19:
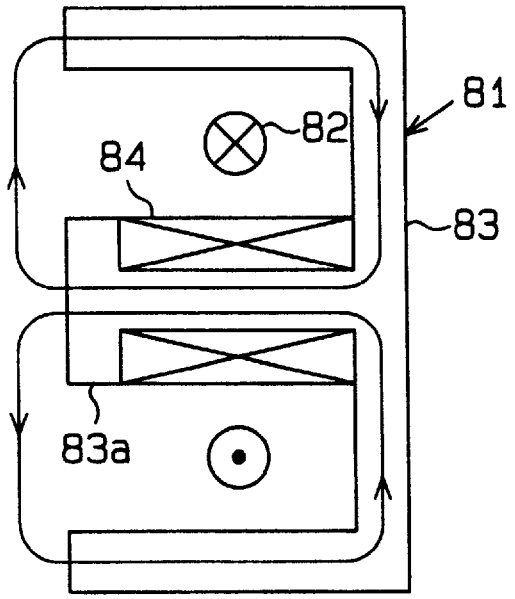
Fig.19 (Prior Art)
FIG. 19 is a diagrammatic front view showing magnetic flux that is produced in a prior art E-shaped core.
Figure 20:
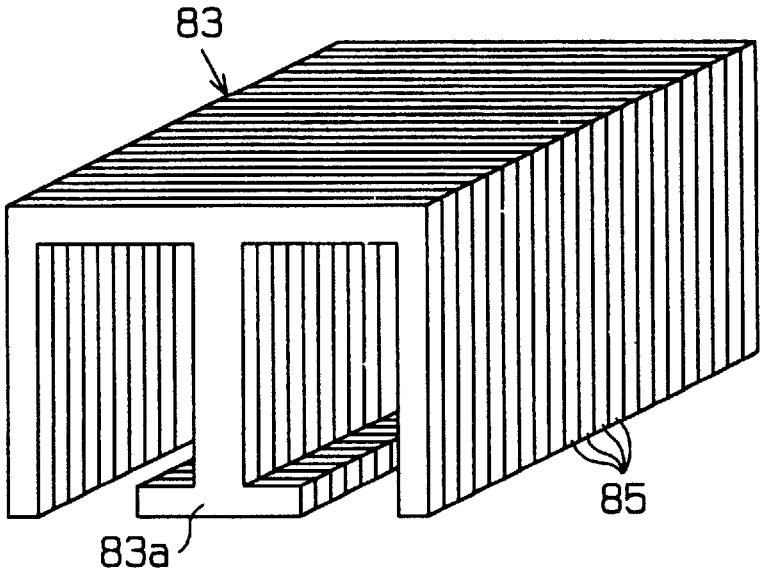
Fig.20 (Prior Art)
FIG. 20 is a perspective view showing a prior art E-shaped core.
Figure 21:
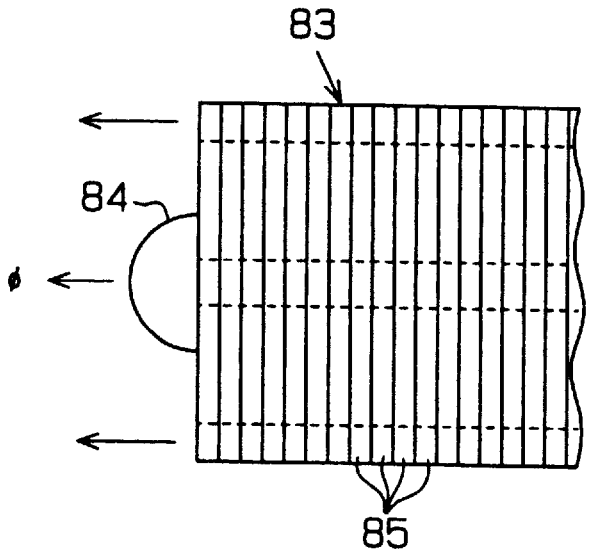
Fig.21 (Prior Art)
FIG. 21 is a diagrammatic partial plan view showing the flux leakage in the prior art E-shaped core.
Figure 22:
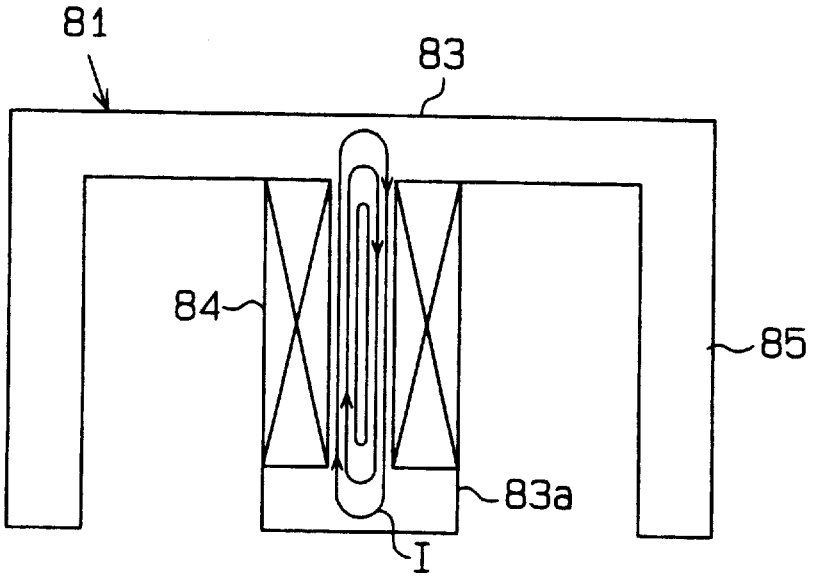
Fig.22 (Prior Art)
FIG. 22 is a diagrammatic front view showing eddy currents generated in the prior art E-shaped core.

FIGS. 18(*a*) and 18(*b*) show further embodiments according to the present invention. FIG. 18(*a*) shows a C-shaped core 90. The core 90 is formed by connecting a plurality of C-shaped plates 92, each of which is provided with notches 91, to one another. The C-shaped core 90 of FIG. 18(*b*) is similarly formed by connecting a plurality of C-shaped plates 94, each of which is provided with elongated holes 95, to one another.

The notches 91 or elongated holes 95 disconnect the path of the eddy currents. Furthermore, the C-shaped core 90 is manufactured simply by laminating a plurality of identical C-shaped plates 92 or 94, which saves production costs.

It should be apparent to those skilled in the art that the present invention may be embodied in many other specific forms without departing from the spirit or scope of the invention. Particularly, it should be understood that the present invention may be embodied in the following forms.

Instead of securing the ferrite or amorphous attachments to the core bodies, these attachments may be arranged in the vicinity of the ends of the body when manufacturing the pickup device 9.

In the illustrated embodiments, the core bodies are formed by connecting together a plurality of plates. However, the core body may be molded. The core body may also be produced by welding steel plates.

The present invention may be applied to automatic carriages or stacker cranes of an automatic warehouse. In other words, the present invention may be applied to cores that are used to transfer power from a power source in a non-contacting manner.

Therefore, the present examples and embodiments are to be considered as illustrative and not restrictive and the invention is not to be limited to the details given herein, but may be modified within the scope of the appended claims.

What is claimed is:

1. A core provided in a pickup device that is attached to a movable body capable of travelling along a guide, wherein said core has a coil wound therearound to obtain electric power based on an electromagnetic induction from alternating current flowing through an electric cable extending along the guide, said core comprising:

a core body; and control means for controlling eddy current caused by leakage flux, said control means being located at an end of the core body to form an end surface of the core.

2. The core as set forth in claim 1, wherein a magnetic circuit is formed with the core based on the alternating current flowing through the cable, and wherein said control means is directed perpendicular to the magnetic circuit.

3. The core as set forth in claim 2, further comprising a portion having the coil wound therearound and an end that includes said control means.

4. The core as set forth in claim 3, wherein said control means is made of a material that has an electrical resistivity greater than that of the core body.

5. The core as set forth in claim 4, wherein said control means is made of a magnetic material.

6. The core as set forth in claim 5, wherein said magnetic material includes a ferrite.

7. The core as set forth in claim 5, wherein said magnetic material includes an amorphous metal.

8. The core as set forth in claim 2, wherein said control means includes obstruction means for obstructing a path of a circuit of the eddy currents.

9. The core as set forth in claim 8, wherein said obstruction means includes a gap formed within the circuit of the eddy currents.

10. The core as set forth in claim 9, further comprising:

a plurality of plates having a predetermined shape, said plates being laminated to form the core body; and a plate positioned at the end of the core body that is divided into pieces by the gap.

11. The core as set forth in claim 9, wherein said obstruction means includes a slit provided with an end surface of the core.

12. The core as set forth in claim 1, wherein said control means includes means for prohibiting formation of magnetic circuit based on the alternating current flowing through the cable, said prohibiting means being provided with the end of the core.

13. The core as set forth in claim 12, further comprising:

a portion having the coil wound therearound, wherein said portion projects from the end of the core to form a recess that functions as said prohibiting means.

14. The core as set forth in claim 13, wherein said portion includes an end having a shape of a bobbin.

15. The core as set forth in claim 1, further comprising:

a plurality of plates having a predetermined shape, said plates being laminated to form the core body; and said control means being formed of a material having a shape identical to that of the plate and an electric resistivity greater than that of the plate.

16. A pickup device attached to a movable body capable of moving along a guide and having a core provided therein, wherein said core has a coil wound therearound to obtain electric power from alternating current flowing through an electric cable extending along the guide, and wherein a magnetic circuit is generated in an end surface of the core based on an alternating current flowing through an electric cable, said device comprising:

a core body; and control means for controlling eddy currents caused by leakage flux, said control means being located at an end of the core body to form the end surface of the core.

17. The device as set forth in claim 16, wherein said control means is directed perpendicular to the magnetic circuit.

18. The device as set forth in claim 17, further comprising: a portion having the coil wound therearound and an end that includes said control means that is made of a material having an electrical resistivity greater than that of the core body.

19. The device as set forth in claim 18, wherein said control means includes a magnetic material.

20. The device as set forth in claim 19, wherein said magnetic material includes a ferrite.

21. The device as set forth in claim 20, wherein said magnetic material includes an amorphous metal.

22. The device as set forth in claim 17, wherein said control means includes a gap for obstructing a path of a circuit of the eddy currents.

23. The device as set forth in claim 22, further comprising:

a plurality of plates having a predetermined shape, said plates being laminated to form the core body; and a plate positioned at the end of the core body that is divided into segments by the gap.

24. The device as set forth in claim 16, further comprising:

a plurality of plates having a predetermined shaped, said plates being laminated to form the core body; and said control means being formed of a material having a shape identical to that of the plate and an electric resistivity greater than that of the plate.

25. The device as set forth in claim 16, wherein said control means includes means for prohibiting formation of a magnetic circuit based on the altering current flowing through the cable, said prohibiting means being provided with end of the core.

26. The device as set forth in claim 22, further comprising:

a portion having the coil wound therearound, wherein said portion projects from the end of the core to form a recess that functions as said prohibiting means.

* * * * *

UNITED STATES PATENT AND TRADEMARK OFFICE

CERTIFICATE OF CORRECTION

PATENT NO. : 5,808,537

DATED : September 15, 1998

INVENTOR(S) : KONDO et al.

It is certified that error appears in the above-identified patent and that said Letters Patent is hereby corrected as shown below:

Column 10, line 13, after " of" insert --a--.

Signed and Sealed this

Twenty-third Day of February, 1999

*Attest:*

Q. TODD DICKINSON

*Attesting Officer*

*Acting Commissioner of Patents and Trademarks*